United States Patent [19]

Gawlick et al.

[11] 4,098,190

[45] Jul. 4, 1978

[54] TRAINING AMMUNITION FOR MORTARS

[75] Inventors: Heinz Gawlick, Vagen-Feldkirchen; Rudolf Stahlmann, Fürth, Bay, both of Fed. Rep. of Germany

[73] Assignee: Dynamit Nobel Aktiengesellschaft, Fed. Rep. of Germany

[21] Appl. No.: 715,499

[22] Filed: Aug. 18, 1976

[30] Foreign Application Priority Data

Aug. 23, 1975 [DE] Fed. Rep. of Germany ..... 2537636

[51] Int. Cl.[2] ..... F42B 13/20

[52] U.S. Cl. ..... 102/41; 102/49.1

[58] Field of Search ..... 102/41, 45, 49.1, 49.2, 102/92.7

[56] References Cited

U.S. PATENT DOCUMENTS

| | | | |
|---|---|---|---|
| 2,853,007 | 9/1958 | Casati | 102/45 |
| 3,118,376 | 1/1964 | Bendersky | 102/49.2 |
| 3,374,738 | 3/1968 | Gawlick et al. | 102/49.1 |

FOREIGN PATENT DOCUMENTS

| | | | |
|---|---|---|---|
| 710,649 | 8/1941 | Fed. Rep. of Germany | 102/49.1 |

*Primary Examiner*—Verlin R. Pendegrass
*Attorney, Agent, or Firm*—Craig & Antonelli

[57] ABSTRACT

Training ammunition for mortars having a projectile disposed in a cartridge case and provided with a propellant charge for being fired from a barrel insert of a dummy shell. An ejector charge is associated with the cartridge case and is provided with an ignition device and is arranged for ejecting the dummy shell together with the cartridge case from the mortar barrel. A flash hole is arranged between the propellant charge and the ejector charge, and an ignition jet conducting tube is disposed coaxially within the ejector charge and extends from the ignition device to the end of the ejector charge facing the flash hole. The ignition jet conducting tube is provided with at least one radial ignition aperture therethrough.

29 Claims, 2 Drawing Figures

TRAINING AMMUNITION FOR MORTARS

Figure 1:
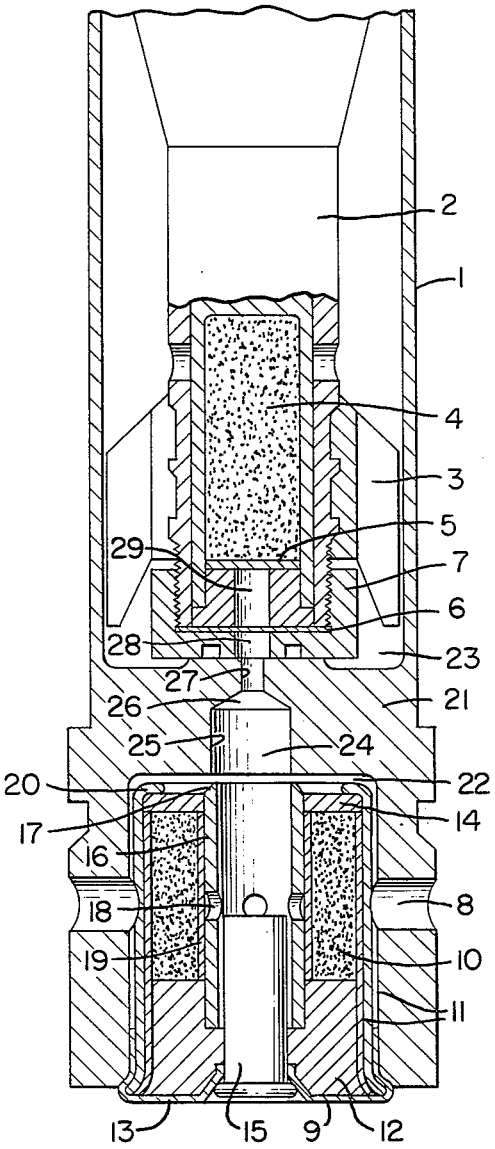

The present invention relates to training ammunition for mortars.

Training ammunition is known for practice firing from mortars wherein the caliber of the training ammunition is designed to be substantially smaller than the corresponding live ammunition and the training ammunition is fired from a barrel insert. In this connection, it is likewise conventional to fashion the training ammunition in the form of cartridges wherein the actual training projectile, together with the propellant charge accommodated therein and optionally also with a signaling or marking charge with the associated percussion primer, is arranged in a cartridge case. These cartridges are introduced, for firing purposes, into the rear portion of the barrel insert and held therein by means of a locking arrangement. Furthermore, the barrel insert is frequently arranged or formed in a dummy shell simulating in shape and dimensions a corresponding, live shell.

In order to eject, with the firing of the training projectile, also the dummy shell with the empty cartridge case from the mortar barrel, an ejector charge can be provided which, for example in accordance with German Pat. No. 1,207,833, is disposed in a separate locking element arranged at the rear end of the dummy projectile or, in accordance with DAS [German Published Application] No. 1,453,823, is located directly in the cartridge case, extended toward the rear, of the training projectile. In this arrangement, a coaxially extending flash hole is provided between the ejector charge and the propellant charge of the training projectile. The flash hole makes it possible to ignite the propellant charge by means of the ignited ejector charge. The ejector charge is ignited, after loading the mortar tube, by impacting the training ammunition on the bottom of the mortar tube, with the aid of a primer means associated with the ejector charge. The thus-evolving gases flow via gas passages into the cavity of the mortor tube surrounding the rear end of the dummy shell and effect the ejection of the dummy shell. The hot flame gases of the ejector charge furthermore flow via the flash hole forwardly in the axial direction and accomplish the ignition of the propellant charge of the training projectile and/or of a propagation charge which is in some cases disposed in front thereof. As has been found under practical conditions, the internal ballistics in such a system are, however, lacking in uniformity to the desired extent, whereby, in turn, fluctuations in the external ballistics and thus in the target accuracy result.

It is therefore an object of the present invention to avoid the above-noted disadvantage of mortor training ammunition of the aforementioned type.

It is another object of the present invention to provide a mortar training ammunition having a maximally uniform internal ballistics characteristic and therefore an improved target accuracy.

In accordance with the present invention, there is provided training ammunition for mortars having a subcaliber training projectile arranged in a cartridge case and provided with a propellant charge, for being fired from a barrel insert of a dummy shell, as well as with an ejector charge having an ignition device for ejecting the dummy shell together with the cartridge case from the mortar tube. Additionally, a flash hole is arranged between the ejector charge and the propellant charge and an ignition jet conducting tube is disposed coaxially within the ejector charge which tube extends from the ignition device to the end of the ejector charge facing the flash hole. The tube is provided with at least one, but preferably several, radial ignition apertures uniformly distributed over the circumference. Optionally, the apertures also extend over the length of the tube.

As has been discovered, the ignition process in total, i.e. the ignition of the ejector charge for the dummy shell and the ignition of the propellant charge of the training projectile, is subject to fluctuations from one shot to the next in the conventional training ammunition. These fluctuations, though very minor, have an adverse effect on the reproducibility of the internal ballistics. By the present invention, these fluctuations are avoided in that the ignition jet conducting tube with its free internal space ensures that the ignition jet emanating in the axial direction from the ignition site can proceed, unimpeded by the ejector charge, through the free ignition jet conducting tube in the direction toward the flash hole and can effect primarily the ignition of the propellant charge or also the ignition of a propagation charge or the like for the training projectile, disposed in front of the propellant charge, if desired. The propellant charge of the training projectile is thus ignited directly from the primer means rather than by the ejector charge. The ejector charge, in turn, is ignited only secondarily by the ignition jet of the primer means, once this jet spreads laterally through the at least one radial ignition aperture of the ignition jet conducting tube.

The features of the present invention make it possible to first ignite the propellant charge of the training projectile, thus initiating same, and only as a secondary step to ignite the ejector charge. As a result, the training projectile is already in its forward motion within the dummy shell before the latter is set into motion by the ejector charge. As has been found, an essential improvement of the internal ballistics is obtained with this chronological procedure, with respect to the propellant charge of the subcaliber training projectile as well as with regard to the ejector charge of the dummy shell, which, in turn, is governing for the intended, high-quality external ballistics of the training projectile.

The ignition device is preferably fashioned as a primer element with a booster charge. For this purpose, an ignition device according to German Pat. No. 1,171,321 is especially well suitable, wherein the ignition jet is so vigorous that even in case of greater distances between the ignition device and the propellant charge it is unnecessary to provide an additional propagation charge. The ignition jet conducting tube is preferably fashioned to be open at its end facing away from the ignition device, so that the ignition jet of the ignition device can enter without impediment into the free flash hole. However, it is also possible, in accordance with the present invention, to arrange a cover of paper or the like at the end of the side of the flash hole, as far as such a cover will not undesirably impair the propagation of the ignition jet into the flash hole. To attain a maximally uniform secondary ignition of the ejector charge, the ignition jet conducting tube is preferably provided with several ignition apertures, for example four lateral bores in a cross-sectional plane. In case of larger ejector charges and consequently longer ignition jet conducting tubes, it is advantageous to arrange two or optionally also more rows of ignition apertures in axial succession.

In accordance with an advantageous embodiment of the present invention, the ignition jet conducting tube is constructed to withstand the gas pressure caused by the ignition device so as to exclude even the minor fluctuations with respect to the ignition of the ejector charge, which are possible due to a premature destruction of the ignition jet conducting tube. In accordance with a further feature of this invention, the flash hole is smaller or is narrowed in its free cross section with regard to the inside cross section of the ignition jet conducting tube. Due to this cross-sectional restriction, the ignition jet is dammed up, whereby the secondary ignition of the charge is enhanced. At the same time, this prevents an excessive amount of gas from flowing from the ignition site to the propellant charge chamber of the training projectile, whereby a nonuniform gas pressure could be produced for the forward movement of the training projectile. This narrowing in cross section can be attained, for example, by fashioning the flash hole over its entire axial length with a diameter smaller than the internal diameter of the ignition jet conducting tube. To avoid the fanning of the ignition jet in the zone of the transition from the ignition jet conducting tube to the flash hole, the flash hole is reduced in the direction toward the propellant charge from a larger cross section preferably corresponding to the inside cross section of the ignition jet conducting tube to a smaller cross section, whereby the ignition jet is focused within the flash hole. This effect, i.e. the concentration of the ignition jet, can be still further enhanced by providing that the transistion from the larger cross section to the smaller cross section is in the form of a shoulder within the flash hole of conical shape.

According to another feature of the present invention, there is provided at least one radial gas passage aperture in the housing portion receiving the ejector charge and the at least one ignition aperture of the ignition jet conducting tube is arranged to be offset with respect to the at least one gas passage aperture of the housing section accommodating the ejector charge. This prevents the casing of the ejector charge from being perforated at an undesirably early point in time in the zone of the gas passage aperture under the effect of the gas pressure, as could occur under adverse circumstances when the ignition aperture and the gas passage aperture are arranged in mutual alignment.

Figure 2:
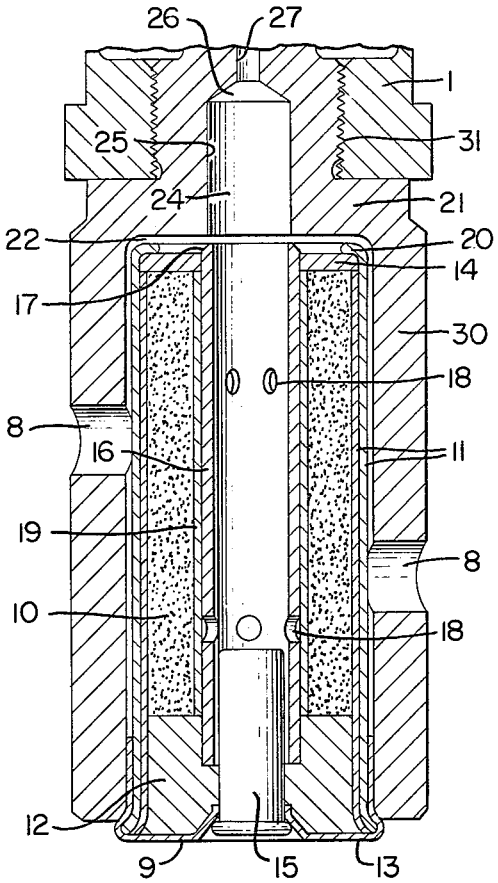

These and other objects, features and advantages of the present invention will become more apparent from the following description when taken in connection with the accompanying drawings, and wherein:

FIG. 1 is a longitudinal sectional view of the rear end of a training cartridge with an ejector cartridge in accordance with one embodiment of the present invention; and FIG. 2 is a longitudinal sectional view of the rear end of a training cartridge in accordance with another embodiment of the present invention.

Referring now to the drawings wherein like reference numerals designate like parts throughout the several views, there is shown in FIG. 1 a cartridge case 1 with a subcaliber training projectile 2 arranged with a tail unit 3. A propellant charge 4 is provided, in the training projectile 2, with thin covers 5 and 6 of paper or the like, which practically do not interfere at all with the ignition, and is held within the case 1 by a screw cap 7. A separate ejection cartridge 9 with an ejector charge 10 is inserted by a friction mount in the rear end of the cartridge case and is provided with at least one radial gas passage 8. The ejector charge 10 could, of course, also be introduced directly into the cartridge case 1. The ejection cartridge 9 includes an outer shell 11 of cardboard, a bottom plug 12 of pressboard, a bottom cap 13 of steel or brass, and a forward cover disk 14 of cardboard. A casing of an ignition device 15, shown in a plan view, is inserted with a booster charge in a frictional mounting in the bottom plug 12. Furthermore, an ignition jet conducting tube 16 made preferably of steel or brass is likewise inserted in a friction mount in the bottom plug 12 and extends over the front end of the ignition device 15. The ignition jet conducting tube extends over the entire axial length of the ejector charge 10 and is passed with its front end 17, which is open, through the cover disk 14. Approximately in the center of the ejector charge 10, the ignition jet conducting tube 16 is provided with four radial bores 18, serving as ignition apertures. A thin cover sleeve 19, for example of paper, is placed over the ignition jet conducting tube 16 and prevents the falling out of parts of the ejector charge 10 through the bores 18, but practically does not interfere at all with the ignition of the ejector charge 10. The cover disk 14, resting on the shell 11 and sleeve 19, is held by means of the flanged-over rim 20.

In the intermediate bottom 21 of the cartridge case 1, separating the cavity 22 for receiving the ejection cartridge 9 from the cavity 23 for the reception of the training projectile 2, a continuous coaxial flash hole 24 is formed which is narrowed in the direction toward the propellant charge 4, in that a zone of smaller cross section 27 follows a zone of larger cross section 25 corresponding to the inside cross section of the ignition jet conducting tube 16, by way of a conical transition or shoulder portion 26. In the bottom of the training projectile 2, coaxial bores 28 and 29 are formed, the cross section of which is larger than that of the zone 27 of the flash hole 24, so that the ignition jet of the ignition means 15, dammed up in the flash hole 24 can ignite the propellant charge 4.

FIG. 2 illustrates another embodiment of the present invention wherein a separate housing portion 30 forms the cavity 22 for receiving the ejection cartridge 9 and is joined to the cartridge case 1 via a threaded connection 31. The ignition jet conducting tube 16, in view of the larger axial length of the ejector charge 10, has two rows of ignition apertures 18 along the axial extent thereof which are arranged to be offset with respect to one another and with respect to the at least one gas passage 8.

While we have shown and described several embodiments in accordance with the present invention, it is understood that the same is not limited thereto but is susceptible of numerous changes and modifications as shown to those skilled in the art and we therefore do not wish to be limited to the details shown and described herein but intend to cover all such changes and modifications as are encompassed by the scope of the appended claims.

We claim:

1. Training ammunition for mortars comprising projectile means disposed in cartridge case means and provided with propellant charge means for being fired from a barrel insert of a dummy shell, ejector charge means associated with said cartridge case means, said ejector charge means including ignition means and being arranged for ejecting the dummy shell together with said cartridge case means from the mortar barrel, means forming a flash hole arranged between said propellant charge means and said ejector charge means, and an ignition jet conducting tube means being disposed coaxially within said ejector charge means and extending from said ignition means to the end of said ejector charge means facing said flash hole means, said ignition jet conducting tube means being provided with at least one radial ignition aperture therethrough, said ignition jet conducting tube means enabling ignition of said propellant charge means prior to enabling ignition of said ejector charge means so as to improve the ballistics of the training ammunition.

2. Training ammunition according to claim 1, wherein said ignition jet conducting tube means is responsive to said ignition means for conducting the ignition jet thereof to said flash hole means.

3. Training ammunition according to claim 1, wherein said projectile means is a subcaliber training projectile.

4. Training ammunition according to claim 1 wherein said ignition jet conducting tube means is provided with a plurality or radial ignition apertures uniformly distributed about the circumference thereof.

5. Training ammunition according to claim 4 wherein said plurality of ignition apertures extend over the length of said ignition jet conducting tube means.

6. Training ammunition according to claim 1 wherein said ignition jet conducting tube means is constructed for withstanding the gas pressure generated by said ignition means.

7. Training ammunition according to claim 1 wherein said ignition jet conducting tube means is provided with a first cross section and said flash hole means is provided with at least a second cross section at a portion thereof smaller than the first cross section of said ignition jet conducting tube means.

8. Training ammunition according to claim 7, wherein said flash hole means is reduced in cross section in the direction toward said propellant charge means, said flash hole means being provided with a first cross section which is larger than said second cross section.

9. Training ammunition according to claim 8, wherein said first cross section of said flash hole means faces said ignition jet conducting tube means to said first cross section of said ignition jet conducting tube means.

10. Training ammunition according to claim 9, wherein said flash hole means includes a transition portion between said first and second cross sections thereof, said transition portion being conical in shape.

11. Training ammunition according to claim 1, further comprising housing means for accommodating said ejector charge means, said housing means being provided with at least one radial gas passage aperture therethrough.

12. Training ammunition according to claim 11, wherein said at least one radial ignition aperture of said ignition jet conducting tube means is offset with respect to said at least one radial gas passage aperture.

13. Training ammunition according to claim 11, further comprising a plurality of radial ignition apertures uniformly distributed about the circumference of said ignition jet conducting tube means and offset with respect to one another along the length of said ignition jet conducting tube means, said at least one gas passage aperture being offset with respect to said ignition aperture.

14. Training ammunition according to claim 11, wherein said housing means is integrally formed with said cartridge case means.

15. Training ammunition according to claim 11, wherein said housing means is separate from said cartridge case means and is connected to said cartridge case means.

16. Training ammunition according to claim 1, wherein said flash hole means includes an axially extending bore disposed in said cartridge case means.

17. Training ammunition according to claim 1, further comprising housing means for accommodating said ejector charge means, said flash hole means including an axially extending bore disposed in said housing means.

18. Training ammunition according to claim 1, wherein said ignition jet conducting tube means surrounds at least a portion of said ignition means, said ignition means providing an ignition jet for being conducted at least through said ignition jet conducting tube means, and said flash hole means to said propellant charge means for igniting said propellant charge means.

19. Training ammunition according to claim 18, wherein said projectile means includes bore means at the rear thereof coaxial with said flash hole means, said bore means being arranged to conduct the ignition jet from said flash hole means therethrough for igniting said propellant charge means.

20. Training ammunition according to claim 19, wherein said ignition jet conducting tube means is provided with a first cross section and said flash hole means is provided with at least a second cross section at a portion thereof smaller than the first cross section of said ignition jet conducting tube means.

21. Training ammunition according to claim 20, wherein said flash hole means is reduced in cross section in the direction toward said propellant charge means, said flash hole means being provided with a first cross section which is larger than said second cross section.

22. Training ammunition according to claim 21, wherein said first cross section of said flash hole means faces said ignition jet conducting tube means and corresponds to said first cross section of said ignition jet conducting tube means.

23. Training ammunition according to claim 22, wherein said bore means of said projectile means has a larger cross section than said second cross section of said flash hole means.

24. Training ammunition according to claim 23, wherein said ejector charge means includes an ejector charge surrounding said ignition jet conducting tube means at least over a portion of the length thereof.

25. Training ammunition according to claim 24, further comprising housing means for accommodating said ejector charge means, said housing means being provided with at least one radial gas passage aperture therethrough.

26. Training ammunition according to claim 25, wherein said at least one radial ignition aperture of said ignition jet conducting tube means is offset with respect to said at least one radial gas passage aperture.

27. Training ammunition according to claim 25, further comprising a plurality of radial ignition apertures uniformly distributed about the circumference of said ignition jet conducting tube means and offset with respect to one another along the length of said ignition jet conducting tube means, said at least one gas passage aperture being offset with respect to said ignition aperture.

28. Training ammunition for mortars comprising projectile means disposed in cartridge case means and provided with propellant charge means for being fired from a barrel insert of dummy shell, ejector charge means associated with said cartridge case means, said ejector charge means including ignition means and being arranged for ejecting the dummy shell together with said cartridge case means from the mortar barrel and ignition jet means for enabling ignition of said propellant charge means prior to enabling ignition of said ejector charge means so as to improve the ballistics of the training ammunition.

29. Training ammunition according to claim 28, wherein said ignition jet means includes means forming a flash hole arranged between said propellant charge means and said ejector charge means, and an ignition jet conducting tube means being disposed coaxially within said ejector charge means and extending from said ignition means to the end of said ejector charge means facing said flash hole means, said ignition jet conducting tube means being provided with at least one radial ignition aperture therethrough, said ignition jet conducting tube means being responsive to said ignition means for initially conducting the ignition jet thereof to said flash hole means for ignition of propellant charge means and thereafter conducting the ignition jet through the at least on radial ignition aperture thereof for ignition of said ejector charge means.

* * * * *